US010364947B2

(12) United States Patent
Jo et al.

(10) Patent No.: US 10,364,947 B2
(45) Date of Patent: Jul. 30, 2019

(54) LED MODULE

(71) Applicant: LUMENS CO., LTD., Yongin-si, Gyeonggi-do (KR)

(72) Inventors: Sungsik Jo, Yongin-si (KR); Seunghyun Oh, Yongin-si (KR); Seunghoon Lee, Yongin-si (KR); Junghyun Park, Yongin-si (KR); Byeonggeon Kim, Yongin-si (KR)

(73) Assignee: LUMENS CO., LTD., Yongin-si (KR)

( * ) Notice: Subject to any disclaimer, the term of this patent is extended or adjusted under 35 U.S.C. 154(b) by 0 days.

(21) Appl. No.: 15/882,877

(22) Filed: Jan. 29, 2018

(65) Prior Publication Data

US 2018/0252373 A1 Sep. 6, 2018

(30) Foreign Application Priority Data

Mar. 6, 2017 (KR) ..... 10-2017-0028574

(51) Int. Cl.

| | |
|---|---|
| ***F21K 9/68*** | (2016.01) |
| ***F21S 4/28*** | (2016.01) |
| ***F21V 7/00*** | (2006.01) |
| ***F21V 7/04*** | (2006.01) |
| ***F21S 41/33*** | (2018.01) |
| ***F21V 19/00*** | (2006.01) |
| ***F21S 41/148*** | (2018.01) |
| ***F21Y 103/10*** | (2016.01) |
| ***F21Y 115/10*** | (2016.01) |

(52) U.S. Cl.

CPC ..... *F21K 9/68* (2016.08); *F21S 4/28* (2016.01); *F21S 41/337* (2018.01); *F21V 7/048* (2013.01); *F21V 19/0015* (2013.01); *F21S 41/148* (2018.01); *F21V 7/005* (2013.01); *F21Y 2103/10* (2016.08); *F21Y 2115/10* (2016.08)

(58) Field of Classification Search

CPC ..... F21S 41/147; F21S 41/148; F21S 41/337; F21S 41/338; F21V 7/005; F21V 7/048

See application file for complete search history.

(56) References Cited

U.S. PATENT DOCUMENTS 6,322,872 B1 * 11/2001 Fuchs ..... B21B 1/227 428/141
2004/0042212 A1 * 3/2004 Du ..... F21S 8/02 362/296.04
2005/0094393 A1 * 5/2005 Czajkowski ..... F21V 7/0008 362/247

(Continued)

*Primary Examiner* — Alexander K Garlen
(74) *Attorney, Agent, or Firm* — Mei & Mark LLP

(57) ABSTRACT

An LED module is disclosed. The LED module includes: light sources elongated in a first direction; a mount supporting the light sources; and a composite reflector integrated with the mount to guide light received from the light sources. The composite reflector includes a first region arranged adjacent to the light sources to reflect light in a second direction substantially orthogonal to the first direction, a third region arranged away from the mount to reflect light in the second direction substantially orthogonal to the first direction, and a second region whose portions overlap the first region and the third region and formed with a plurality of diffraction lines through which light is diffused in the second direction. The diffraction lines formed on the composite reflector diffract incident light and direct the diffracted light toward the light receiving unit.

10 Claims, 6 Drawing Sheets

(56) References Cited

U.S. PATENT DOCUMENTS

| | | | | |
|---|---|---|---|---|
| 2008/0225540 | A1* | 9/2008 | Tsukamoto | F21V 13/04 362/514 |
| 2010/0157607 | A1* | 6/2010 | Venhaus | F21V 7/0008 362/294 |
| 2010/0238660 | A1* | 9/2010 | Miyairi | F21V 7/0008 362/235 |
| 2010/0271816 | A1* | 10/2010 | Ozeki | A47F 3/001 362/217.05 |
| 2011/0090685 | A1* | 4/2011 | Peck | F21V 7/04 362/235 |
| 2011/0280019 | A1* | 11/2011 | Zimmer | F21V 7/0008 362/294 |
| 2013/0235589 | A1* | 9/2013 | Ohno | F21V 7/0066 362/301 |

* cited by examiner

| Diffraction lines | FWHM | Peak spacing |
|---|---|---|
| Reference/ not applied | 17.1mm | 0mm |
| 2μm | 17.8mm | 4.5mm |
| 4μm | 18.6mm | 9.7mm |
| 6μm | 19.7mm | 14.3mm |

LED MODULE

BACKGROUND OF THE INVENTION

1. Field of the Invention

The present invention relates to a light emitting diode (LED) module, and more particularly to an LED module including a composite reflector formed with diffraction lines through which light can be diffused.

The LED module of the present invention diffuses light over a wide area rather than focuses light on a narrow area, achieving improved luminance uniformity. The LED module of the present invention is particularly suitable for use in a backlight unit for a television.

2. Description of the Related Art

A general backlight unit reflects light using a reflection mechanism but distributes light over a narrow area and does not disperse light due to the rectilinear propagation of light, resulting in non-uniform luminance To solve such problems, some backlight units provided with diffraction gratings are known. Such a backlight unit includes a light guide plate having fine diffraction patterns formed on the upper or lower surface thereof and light sources arranged at one lateral side of the light guide plate to disperse light.

White light emitted from the light sources enters through one lateral side of the light guide plate and propagates inside the light guide plate by total reflection. For example, the light guide plate is made of a material with high transmittance.

A portion of the light incident on the upper surface of the light guide plate is diffracted by the diffraction patterns formed on the upper surface of the light guide plate. The diffracted light is emitted through the upper surface of the light guide plate and is uniformly diffused by a diffusion plate to illuminate a flat panel display.

The conventional backlight unit suffers from the inconvenience that the diffusion plate designed to diffuse the light emitted from the light guide plate requires the use of a light collecting plate for converting the diffused light into front light.

When white light is emitted from the upper surface of the light guide plate through the diffraction patterns, color dispersion occurs, which is explained by the fact that refractive index and transmittance vary depending on the wavelength of light. That is, since the angle of emission of the light emitted from the diffraction patterns is determined by the wavelength of the light, color separation is caused when the diffraction patterns have the same pitch.

SUMMARY OF THE INVENTION

The present invention has been made in an effort to solve the problems associated with the prior art, and it is an object of the present invention to provide an LED module constructed such that light emitted from light sources is received by a composite reflector and is diffused by diffraction lines formed on the composite reflector.

Other objects of the invention will be understood by the following description.

An aspect of the present invention provides an LED module including: light sources elongated in a first direction; a mount supporting the light sources; and a composite reflector integrated with the mount to guide light received from the light sources, wherein the composite reflector includes a first region arranged adjacent to the light sources to reflect light in a second direction substantially orthogonal to the first direction, a third region arranged away from the mount to reflect light in the second direction substantially orthogonal to the first direction, and a second region whose portions overlap the first region and the third region and formed with a plurality of diffraction lines through which light is diffused in the second direction.

A light collection region where a large portion of light emitted from the light sources is collected on the composite reflector is formed at an angle of 33° vertically upward from the light sources.

The second region is formed on the inner surface of the composite reflector to diffract light and is defined by the mount and the inner surface of the composite reflector that form an angle of 71° to 104° with each other in the clockwise direction from the plane of the paper.

The first region is formed on the inner surface of the composite reflector to reflect light and is defined by the mount and the inner surface of the composite reflector that form an angle of 71° with each other in the clockwise direction from the plane of the paper.

The third region is formed on the inner surface of the composite reflector to reflect light and is defined by the mount and the inner surface of the composite reflector that form an angle of 104° with each other in the clockwise direction from the plane of the paper.

The plurality of diffraction lines included in the second region are formed in the first direction.

The diffraction lines have a width of 20 μm to 40 μm.

The number of the diffraction lines is from 2000 to 3000.

The diffraction lines are directly formed in the second region.

The diffraction lines are formed by deposition of hairline-patterned tapes.

The light sources are arranged such that their edges face each other.

The light sources are arranged in a zigzag pattern.

In the LED module of the present invention, the composite reflector receiving light emitted from the light sources is constructed to include a region where diffraction lines are formed and regions where no diffraction lines are formed. This construction is effective in light diffusion over a wide area and achieving improved luminance and color uniformity.

BRIEF DESCRIPTION OF THE DRAWINGS

Reference will now be made in detail to embodiments, examples of which are illustrated in the accompanying drawings. The drawings are used to help easily understood the invention and it should be understood that the scope of the invention is not limited by the drawings.

DETAILED DESCRIPTION OF THE INVENTION

As the present invention allows for various changes and numerous embodiments, particular embodiments will be illustrated in drawings and described in detail in the written description.

However, this is not intended to limit the present invention to particular modes of practice, and it is to be appreciated that all changes, equivalents, and substitutes that do not depart from the spirit and technical scope of the present invention are encompassed in the present invention.

Embodiments presented for light diffusion by diffraction in the present invention are merely illustrative and are intended to discuss the scope and spirit of the invention.

Any reference herein to 'top', 'bottom', 'front', 'back', 'left', 'right,' etc. used to represent the directions of elements, such as light sources, a composite reflector, and diffraction lines, is not intended to be a limitation herein.

Herein, the term 'about' when applied to a value generally means within the tolerance range of the equipment used to produce the value, or in some examples, means plus or minus 1%, or plus or minus 5%, unless otherwise expressly specified.

An expression used in the singular encompasses the expression of the plural, unless it has a clearly different meaning in the context. For example, the expression "at least one diffraction line" is used to mean a plurality of lines when expressed linguistically.

Use of the verb "include" and its conjugations does not exclude the presence of elements or steps other than those stated in the claims or description. The article "a" or "an" preceding an element does not exclude the presence of a plurality of such elements. The use of the terms first, second, third, etc. does not imply any order. These terms are only used to distinguish one element from another element.

Preferred embodiments of an LED module according to the present invention will be described with reference to the accompanying drawings.

Figure 1A:
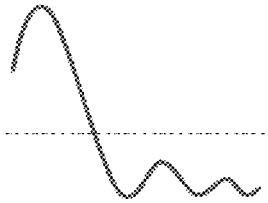
FIGS. 1*a* to 1*c* show the principle that light having passed through diffraction gratings overlaps and its diffusion area is variable.
Figure 1B:
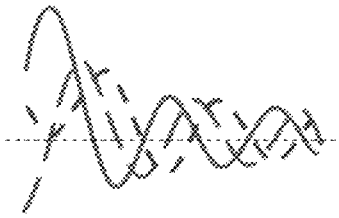
Figure 1C:
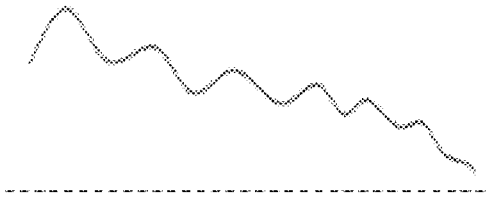

FIGS. 1*a* to 1*c* show the principle that light having passed through diffraction lines overlaps and its diffusion area is variable.

The luminance distribution of light having passed through a light reflecting member without diffraction lines is shown in FIG. 1*a*. The luminance distribution of light having passed through diffraction lines is variable, as shown in FIG. 1*b*. When a plurality of light beams having passed through diffraction lines overlap and interfere with each other, their luminance distribution is variable, as shown in FIG. 1*c*.

The present invention is associated with the diffusion of light toward a light receiving unit based on the principle of light interference.

Figure 2:
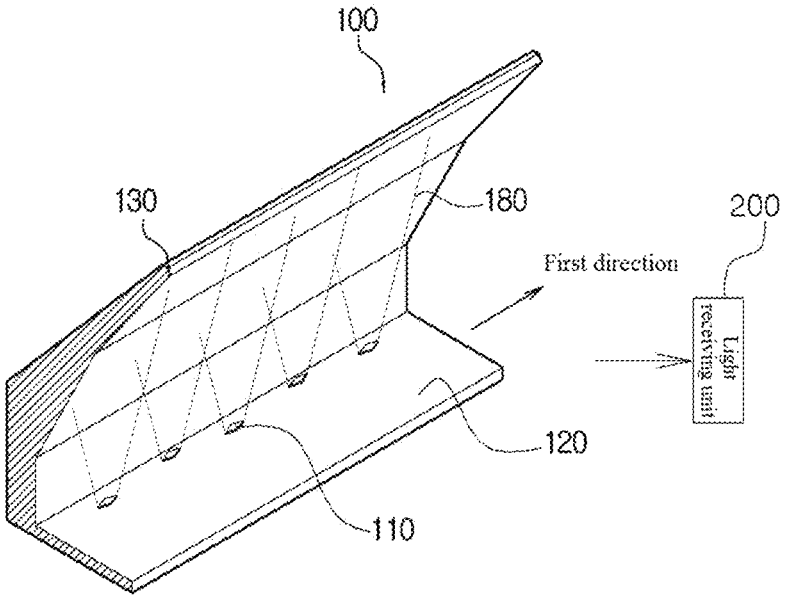
FIG. 2 is a view illustrating the construction of an LED module to which the principle described in the present invention is applied.
Figure 3:
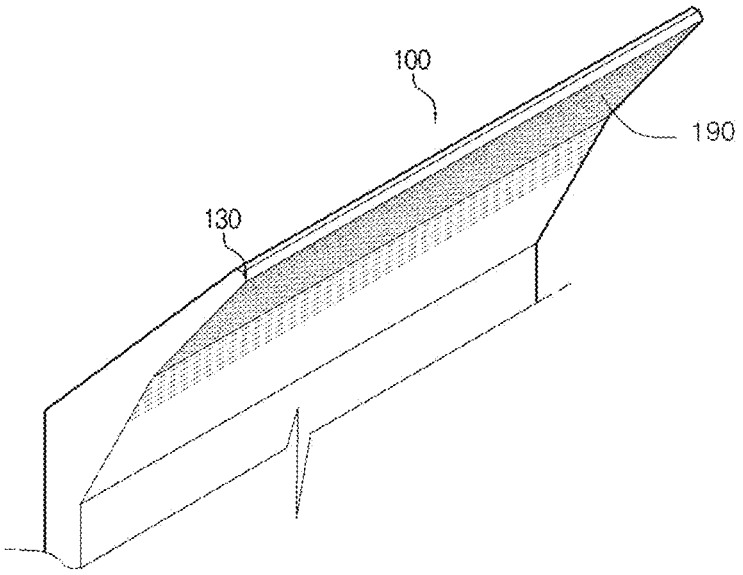
FIG. 3 is an exemplary view illustrating diffraction lines formed on a composite reflector of an LED module according to the present invention.
Figure 4:
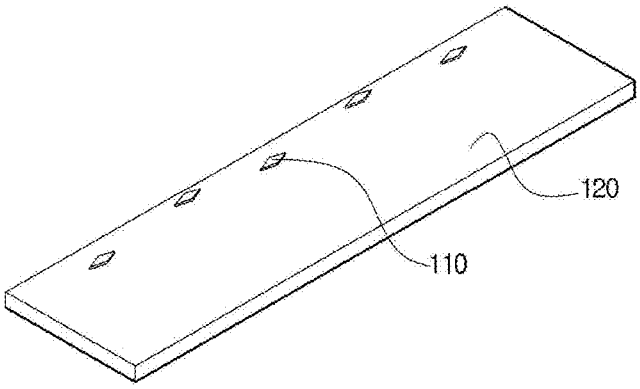
FIG. 4 illustrates a zigzag arrangement of light sources on a mount of an LED module according to the present invention.
Figure 5:
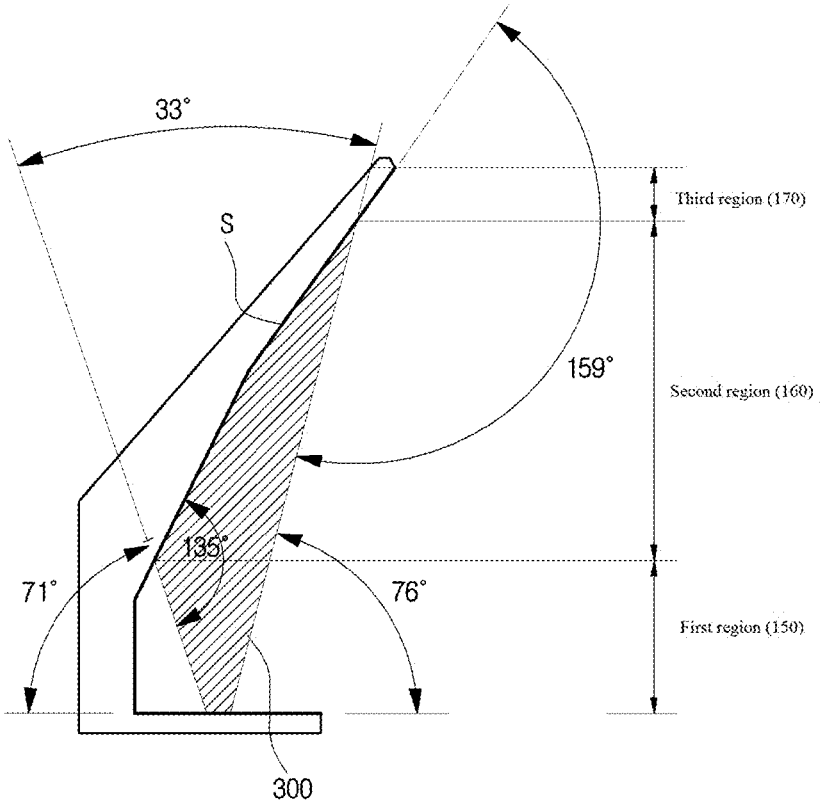
FIG. 5 explains the principle of light diffusion by a composite reflector of an LED module according to the present invention.

FIG. 2 is a view illustrating the construction of an LED module to which the principle described in the present invention is applied, FIG. 3 is an exemplary view illustrating diffraction lines formed on a composite reflector of an LED module according to the present invention, FIG. 4 illustrates a zigzag arrangement of light sources on a mount in an LED module of the present invention, and FIG. 5 explains the principle of light diffusion by a composite reflector of an LED module according to the present invention.

Referring to FIGS. 2 to 5, an LED module 100 includes: light sources 110 elongated in a first direction (horizontal direction); a mount 120 supporting the light sources 110; and a composite reflector 130 integrated with the mount 120 to guide light received from the light sources 110 to a light receiving unit 200.

The light sources 110 are arranged such that their edges face each other. With this arrangement, light can be emitted toward the composite reflector 130 with improved efficiency. The plurality of light sources 110 are arranged in the first direction on the mount 120. The mount 120 may be a substrate.

The light sources 110 are alternately arranged in a zigzag pattern such that the adjacent ones of the light sources are not in line with each other. The light sources 110 are distributed in one direction. The arrangement and distribution of the light sources 110 can minimize non-uniformity of light caused by light overlapping, which is a problem encountered in a linear arrangement of LEDs.

The light sources 110 may include three types of LEDs having different wavelengths, i.e. red LEDs, green LEDs, and blue LEDs. Light is incident on the composite reflector 130 at an angle relative to the normal line to the surface of diffraction lines. The incident light is diffracted and red, green, and blue light beams are emitted at different angles from the diffraction lines.

In a light collection region 300, a large portion of light emitted from the light sources 110 is collected on the composite reflector 130. The light collection region 300 is at an angle of 33° vertically upward from the light sources.

The composite reflector 130 is arranged adjacent to the light sources 110 to receive light emitted from the light sources 110. The composite reflector 130 includes a first region 150 and a third region 170 where light is reflected in a second direction substantially orthogonal to the first direction along which the light sources 110 are arranged.

The composite reflector 130 includes a second region 160 whose portions overlap the first region 150 and the third region 170 and formed with a plurality of diffraction lines 190 to diffract the incident light and direct the diffracted light toward the light receiving unit 200.

The first region 150 is formed on the inner surface of the composite reflector 130 to reflect light and is defined by the mount 120 and the inner surface S of the composite reflector 130 that form an angle of 71° with each other in the clockwise direction from the plane of the paper.

The second region 160 is formed on the inner surface of the composite reflector 130 to diffract light and is defined by the mount 120 and the inner surface S of the composite reflector 130 that form an angle of 71° to 104° with each other in the clockwise direction from the plane of the paper. The third region 170 is formed on the inner surface S of the composite reflector 130 to reflect light and is defined by the mount 120 and the inner surface S of the composite reflector 130 that form an angle of 104° with each other in the clockwise direction from the plane of the paper.

FIG. 3 is an exemplary view illustrating the diffraction lines 190 formed in the second region 160.

The diffraction lines 190 are formed in the lengthwise direction of the composite reflector 130, i.e. in the first direction (horizontal direction) along which the light sources 110 are arranged. The diffraction lines 190 may be formed in various shapes. For example, the diffraction lines 190 may have a circular, quadrangular or sinusoidal shape in cross section.

The width of the diffraction lines 190 is 20 μm to 40 μm and the number of the diffraction lines 190 is from 2000 to 3000.

The diffraction lines 190 may be directly formed in the second region 160. Alternatively, the diffraction lines 190 may be formed by deposition of hairline-patterned tapes.

The LED module 100 is constructed such that light is emitted from the light sources 110 and reflected and diffracted by the first region 150, the second region 160, and the third region 170 to provide a plurality of light beams directed toward the light receiving unit 200.

Specifically, light 180 emitted from the light sources 110 is incident on the composite reflector 130 where it is reflected from the first region 150 and the third region 170 and is reflected and diffracted by the diffraction lines 190 formed in the second region 160 overlapping a portion of the first region 150 and a portion of the third region 170 to produce a plurality of light beams interfering with each other.

The diffraction lines 190 are inclined at an angle corresponding to the inclination of the plane of reflection to reflect the incident light. As a result of the reflection and diffraction by the diffraction lines 190, a plurality of light beams are produced and are directed toward the light receiving unit 200. The angle of the light 180 directed toward the light receiving unit 200 relative to the diffraction lines 190 is dependent on various factors, such as the refractive index of the plane of reflection, the spacing distance between the diffraction lines 190, and the wavelength of the light.

According to several embodiments, the diffraction lines 190 formed on the surface of the composite reflector 130 to diffract the incident light may have various shapes to diversify the angle and direction of a plurality of diffracted light beams directed toward the light receiving unit 200.

This diffraction can be expressed by Equation 1:

$$2d \sin \theta = n\lambda \quad (1)$$

where d is the spacing distance between the lines, θ is the angle of incident light, λ is the wavelength of light, and n is an integer.

According to Equation 1, the number and size of the diffraction lines 190 can be adjusted to create phase differences between diffracted light beams.

Experiments were conducted on the diffusion of light using diffraction lines. The experimental results will be explained with reference to the drawings.

Figures 6, 7:
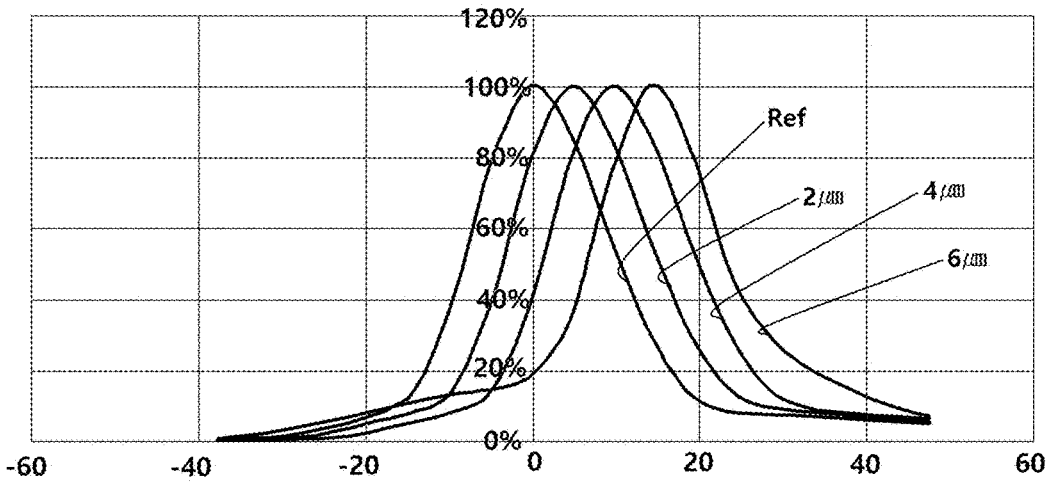
FIG. 6 shows changes in full width at half maximum and peak spacing with varying sizes of diffraction lines.
FIG. 7 shows color spectra.

FIG. 6 shows full widths at half maximum measured for diffraction lines having different sizes (depths) and FIG. 7 shows color spectra.

The experimental values presented in FIG. 6 demonstrate how changes in full width at half maximum and peak spacing for light diffusion were caused by the size of diffraction lines.

The full width at half maximum and the light peak spacing for the composite reflector 130 without diffraction lines were 17.1 mm and 0 mm, respectively. In contrast, the full width at half maximum and the light peak spacing for the composite reflector 130 formed with diffraction lines having a size of 2 μm increased to 17. 8 mm and 4.5 mm, respectively. The full width at half maximum and the light peak spacing of the composite reflector 130 formed with diffraction lines having a size of 4 μm increased to 18.6 mm and 9.7 mm, respectively. The full width at half maximum and the light peak spacing of the composite reflector 130 formed with diffraction lines having a size of 6 μm increased to 19.7 mm and 14.3 mm, respectively.

That is, when the size of the diffraction lines increased by 2 μm, the light peak spacing and the full width at half maximum were found to increase by ~4 mm and ~1 mm, respectively, leading to the conclusion that the full width at half maximum and the light peak spacing increased in proportion to the size of the diffraction lines.

These experimental results show that the size of the diffraction lines is associated with the full width at half maximum and the light peak spacing and affects light diffusion.

Figure 8A:
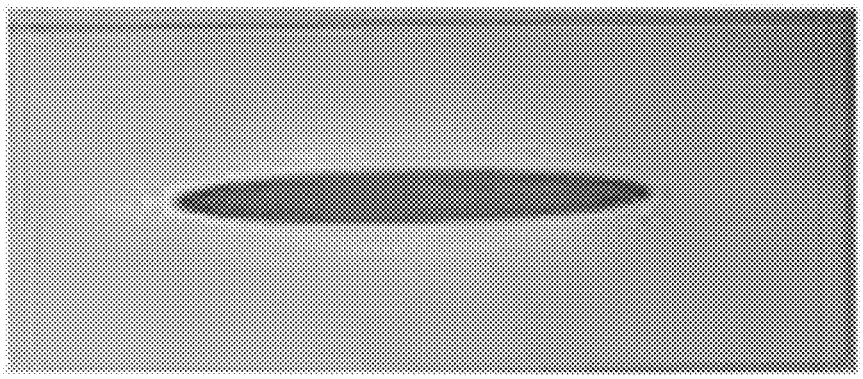
FIG. 8*a* shows the distribution of light reflected from a composite reflector without diffraction lines.
Figure 8B:
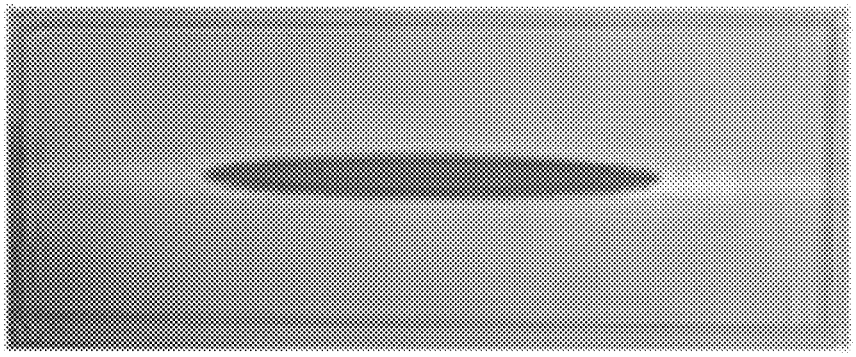
FIG. 8*b* shows the distribution of light diffracted through a composite reflector of an LED module according to the present invention.

FIG. 8*a* shows the distribution of light reflected from the composite reflector without diffraction lines and FIG. 8*b* shows the distribution of light diffracted through the composite reflector.

When light emitted from the light sources 110 was simply reflected from the plane of reflection, it was focused on a narrow range, as shown in FIG. 8*a*. In contrast, the use of the diffraction lines enabled light diffusion over a wide range with improved luminance, as shown in FIG. 8*b*.

Figure 9:
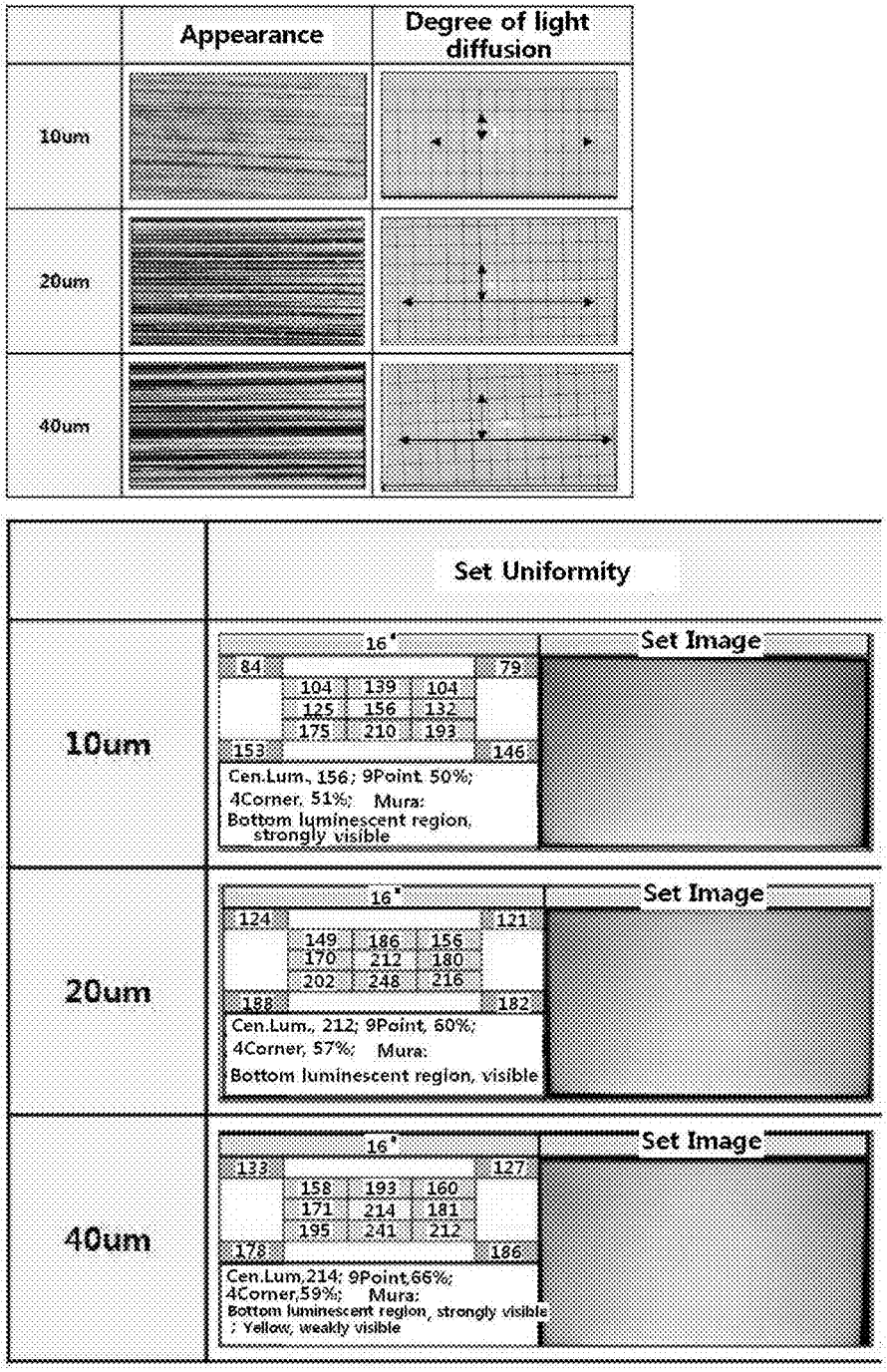
FIG. 9 shows data on the diffusion of light through diffraction lines having different sizes.

FIG. 9 shows data on the diffusion of light through diffraction lines having different sizes.

The effects of light diffusion through diffraction lines having different sizes (widths) of 10 μm, 20 μm, and 40 μm were compared. The results conclude that a larger size of the diffraction lines is more effective in light diffusion. Particularly, the diffraction lines having a size of 20 μm of 40 μm provide better light diffusion. In addition, it was found that the number of the diffraction lines corresponding to their size is preferably in the range of 2,000 to 3,000.

Although the LED module using diffraction lines has been described herein with reference to the foregoing embodiments, it should be understood that the above-described embodiments are merely illustrative of some of the many specific embodiments that represent the principles described herein. Clearly, those skilled in the art can readily devise numerous other arrangements without departing from the scope as defined by the following claims.

What is claimed is:

1. An LED module comprising:

light sources elongated in a first direction;

a mount supporting the light sources; and a composite reflector integrated with the mount to guide light received from the light sources, wherein the composite reflector comprises:

a first region arranged adjacent to the light sources to reflect light in a second direction substantially orthogonal to the first direction, a third region arranged away from the mount to reflect light in the second direction substantially orthogonal to the first direction, and a second region interposed between the first region and the third region and formed with a plurality of diffraction lines through which light is diffused in the second direction, wherein the first region is devoid of the diffraction lines, wherein the light from the light source is collected more in the second region than in the first region and the third region, wherein the first region includes a first area substantially orthogonal to the mount and a second area intersecting the first area at an obtuse angle, wherein the second region includes a first main diffraction area extending from one end of the second area at the same slope as the second area and a second main diffraction area intersecting the first main diffraction area at an obtuse angle, wherein the slope of the second diffraction area is the same as the slope of the third region, and wherein the light sources comprise a first row of light sources located closer to a boundary between the mount and the composite reflector and a second row of light sources located farther from the boundary, such that the light sources are alternately arranged in a zigzag pattern.

2. The LED module according to claim 1, wherein the second region is formed at an angle of 33° vertically upward from the light sources.

3. The LED module according to claim 1, wherein the second region is formed on the inner surface of the composite reflector to diffract light and is defined by the mount and the inner surface of the composite reflector that form an angle of 71° to 104° with each other in the clockwise direction from the plane of the paper.

4. The LED module according to claim 1, wherein the first region is formed on the inner surface of the composite reflector to reflect light and is defined by the mount and the inner surface of the composite reflector that form an angle of 71° with each other in the clockwise direction from the plane of the paper.

5. The LED module according to claim 1, wherein the third region is formed on the inner surface of the composite reflector to reflect light and is defined by the mount and the inner surface of the composite reflector that form an angle of 104° with each other in the clockwise direction from the plane of the paper.

6. The LED module according to claim 1, wherein the plurality of diffraction lines formed in the second region are formed in the first direction.

7. The LED module according to claim 6, wherein the diffraction lines have a width of 20 μm to 40 μm.

8. The LED module according to claim 6, wherein the number of the diffraction lines is from 2000 to 3000.

9. The LED module according to claim 6, wherein the diffraction lines are directly formed in the second region.

10. The LED module according to claim 6, wherein the diffraction lines are formed by deposition of hairline-patterned tapes.

* * * * *